US008413405B2

(12) United States Patent
Meesenburg

(10) Patent No.: US 8,413,405 B2
(45) Date of Patent: Apr. 9, 2013

(54) TOWER OF A WIND POWER PLANT

(75) Inventor: Uwe Meesenburg, Friedrichstadt (DE)

(73) Assignee: Repower Systems SE, Hamburg (DE)

( * ) Notice: Subject to any disclaimer, the term of this patent is extended or adjusted under 35 U.S.C. 154(b) by 78 days.

(21) Appl. No.: 12/640,718

(22) Filed: Dec. 17, 2009

(65) Prior Publication Data

US 2010/0154351 A1 Jun. 24, 2010

(30) Foreign Application Priority Data

Dec. 19, 2008 (DE) ..... 10 2008 063 846
Mar. 17, 2009 (DE) ..... 10 2009 013 186

(51) Int. Cl.
*E04H 12/34* (2006.01)

(52) U.S. Cl.
USPC ..... 52/745.17; 52/651.01

(58) Field of Classification Search ..... 52/745.17, 52/745.18, 651.01, 651.07; 182/178.3, 178.4, 182/178.5, 178.6; D25/6
See application file for complete search history.

(56) References Cited

U.S. PATENT DOCUMENTS 3,618,702 A 11/1971 Hendrix
3,768,016 A * 10/1973 Townsend et al. ..... 455/25
4,272,929 A * 6/1981 Hanson ..... 52/40
4,907,675 A * 3/1990 Saby et al. ..... 182/178.5
5,097,647 A * 3/1992 Sopik et al. ..... 52/651.07
D332,086 S * 12/1992 Hoffmeister ..... D13/155
D342,794 S * 12/1993 Muenzel et al. ..... D25/6
6,173,537 B1 * 1/2001 Davidsson et al. ..... 52/40
6,467,233 B1 * 10/2002 Maliszewski et al. ..... 52/831
6,470,645 B1 * 10/2002 Maliszewski et al. ..... 52/745.18
7,982,330 B1 * 7/2011 Ueno et al. ..... 290/55
8,146,320 B2 * 4/2012 Seidel et al. ..... 52/651.01

(Continued)

FOREIGN PATENT DOCUMENTS

CN 1688809 A 10/2005
CN 201106533 Y 8/2008

(Continued)

OTHER PUBLICATIONS

Selected documents from the Prosecution History of Australian Patent Application No. 2009245878 (25 pages total): Aug. 31, 2012 IP Australia Patent Examination Report No. 3 (4 pages); Applicant's Sep. 12, 2012 Response (20 pages); and IP Australia Sep. 14, 2012 Notice of Acceptance (1 page).*

*Primary Examiner* — Basil Katcheves
*Assistant Examiner* — Rodney Mintz
(74) *Attorney, Agent, or Firm* — Rankin, Hill & Clark LLP

(57) ABSTRACT

A method for erecting a tower of a wind power plant made of at least three tube-shaped tower segments. For this a tower segment is connected at its ends with another tower segment in each case: in which the tower segments are arranged in a predetermined sequence of the type tower segment A-tower segment B-tower segment C one upon the other, in which the first tower segment A is selected arbitrarily from a provided plurality $i \geqq 2$ of first tower segments $A_i$ which are constructed in the same way among themselves and exchangeable one for the other, in which the second tower segment B is selected arbitrarily from a provided plurality $m \geqq 2$ of second tower segments $B_m$ which are constructed in the same way among themselves and exchangeable one for the other, and in which the third tower segment C is selected arbitrarily from a provided plurality $n \geqq 2$ of third tower segments $C_n$.

24 Claims, 6 Drawing Sheets

U.S. PATENT DOCUMENTS

| | | | | |
|---|---|---|---|---|
| 2005/0042099 | A1* | 2/2005 | Wobben | 416/132 B |
| 2006/0225379 | A1 | 10/2006 | Seidel et al. | |
| 2006/0233645 | A1* | 10/2006 | Wobben | 416/132 B |
| 2006/0272244 | A1* | 12/2006 | Jensen | 52/223.5 |
| 2007/0296220 | A1* | 12/2007 | Kristensen | 290/55 |
| 2008/0145232 | A1* | 6/2008 | Ollgaard | 416/244 A |
| 2010/0006710 | A1* | 1/2010 | Lyness et al. | 248/70 |
| 2010/0126079 | A1* | 5/2010 | Kristensen | 52/40 |
| 2010/0281818 | A1* | 11/2010 | Southworth | 52/745.17 |
| 2010/0313497 | A1* | 12/2010 | Jensen | 52/173.1 |
| 2011/0140446 | A1* | 6/2011 | Knoop | 290/55 |
| 2012/0301295 | A1* | 11/2012 | Mutius | 416/1 |

FOREIGN PATENT DOCUMENTS

| | | | |
|---|---|---|---|
| DE | 29500874 | U1 | 5/1995 |
| DE | 19609006 | | 9/1997 |
| DE | 102005049288 | A1 | 4/2007 |
| EP | 1775419 | A1 | 4/2007 |
| EP | 2199497 | A3 * | 5/2012 |
| FR | 2565286 | | 12/1985 |
| WO | 03/036084 | A1 | 5/2003 |
| WO | 2004/031578 | A1 | 4/2004 |
| WO | 2004/083633 | A1 | 9/2004 |
| WO | 2006/024832 | A1 | 3/2006 |

* cited by examiner

TOWER OF A WIND POWER PLANT

BACKGROUND OF THE INVENTION

1. Field of the Invention

The invention concerns a method for erecting a tower of a wind power plant made of at least three tube-shaped tower segments. Furthermore the invention concerns a tower of a wind power plant, where the tower will be or is constructed from multiple tower segments, as well as the use of ladders during or for the erection of a tower of a wind power plant and a use of power rails in a tower of a wind power plant.

2. Description of Related Art

Wind power plants of the patent applicant are known by the designation 5M, MM92, MM82, MM70 and MD77.

Modern wind power plants generally have a tower on which a machine housing or nacelle with a rotor is set. The tower is formed, in particular, as a steel shell tower and generally has a tapering form.

Furthermore, the tower itself generally consists of steel tower sections, which are optionally composed of prefabricated shell segments.

In WO-A-2004/083633 a steel tower of a wind power plant is described as well as a method for building a large-sized, cylindrical or conical tower for a wind power plant.

Furthermore, in WO-A-03/036084 a wind power plant is disclosed which has a tower constructed from multiple tower segments, a generator arranged near the tower head, a power module arranged near the tower base and power rails premounted in the tower segments for carrying current from the generator to the power module.

In many known wind power plants, the electric power module of the wind power plant, which includes electrical units such as the transformer, electrical cabinets, possibly an inverter module, a medium voltage system, a low voltage distribution board, etc., is below the generator level and frequently arranged near the base of the tower of the wind power plant or also within the machine housing on the tower head. In order to transfer the electrical energy, which is produced by the generator located near the top of the tower within a nacelle, to the power module and/or to the grid connection, power rails are provided, which run inside the tower in most cases.

As a further example, in EP-A-1 775 419 a vertical ladder for a wind power plant is disclosed, in which the vertical ladder is arranged in the interior of the tower along the tower wall from the bottom to the top.

BRIEF SUMMARY OF THE INVENTION

Based on this state of the art, the object of the present invention is to simplify the erection of a tower for a wind power plant made of multiple tower segments, in which preferably in the tower segments cable-like or linearly oriented devices, such as vertical ladders or power rails, are to be premounted.

The object is solved by a method for erecting a tower of a wind power plant made of at least three tube-shaped tower segments, in which a tower segment is connected at its ends with another tower segment in each case,

- in which the tower segments are arranged in a predetermined sequence of the type tower segment A-tower segment B-tower segment C, one upon the other,
- in which the first tower segment A is selected arbitrarily from a provided plurality $i \geqq 2$ of first tower segments A, which are constructed in the same way among themselves and exchangeable one for the other,

- in which the second tower segment B is selected arbitrarily from a provided plurality $m \geqq 2$ of second tower segments $B_m$ which are constructed in the same way among themselves and exchangeable one for the other,
- in which the third tower segment C is selected arbitrarily from a provided plurality $n \geqq 2$ of third tower segments $C_n$ which are constructed in the same way among themselves and exchangeable one for the other.

By the provision of as many tower segments as desired of different constructions which can be combined with one another, a tower will be erected in a simple, fast manner, with the tower segments to be connected, freely selected without restriction as well the assemblies arranged therein, such as vertical ladders or means of conducting current, which preferably run along the tower wall and are connected to one another using corresponding assembly (length) adapters, such as insertable vertical ladder intermediate pieces, with which in particular length differences or spacing differences, such as with vertical ladders, are compensated so that the various tower segments $A_i$, $B_m$, $C_n$, etc. of the constructions A, B, C, etc., can be combined arbitrarily with one another and are connectable to each other.

In contrast to this, according to the state of the art, tower segments are appropriately and individually adapted to one another, so that one particular tower segment is exclusively, very exactly attachable and/or attached to a particular specified tower segment, which makes each tower of wind power plants a distinctive, individual construct with exact and characteristic tower segment properties based on the tower segments individually matched to one another According to the invention, non-individualized tower segments of various constructions or construction types are provided without individually matching or adapting a tower segment to another tower segment. The use of non-individualized tower segments of multiple constructions (construction type A, B, C, etc.) simplifies the handling of tower segments and consequently the erection of wind power towers. The inventive tower segments of one construction are in each case indistinguishable among themselves or not individualized and not exactly matched or adapted to a specified particular, individual tower segment of another construction.

The non-individualized tower segments of various constructions are not distinguishable in each case within the corresponding construction class, whereas among one another between the construction classes or types (construction type A, B, C, etc.) differences exist, in order to construct a tower from tower segments which are not individually specified, for example, of the arrangement tower segment A-tower segment B-tower segment C. Consequently, within the construction types, multiple uniform, non-individualized and interchangeable tower segments of the construction type are provided.

Due to the length tolerances in the tower construction of wind power plants, constructed in the same way does not mean identical, but rather made according to the same production drawing with non-individualized assemblies. The length tolerances, for instance of multiple centimeters, which occur despite the same construction of the tower segments, are compensated by the inventive embodiment with very little effort and expense without an individual adaptation of the tower segments.

Furthermore, the tower segments of the various tower segment constructions which are not individually manufactured and/or adapted also have non-individualized assemblies, such as vertical ladders, in which the assemblies of the tower segments of different construction types are connected to one another. The individual adaptation of the connection length between the assemblies takes place through corresponding adapter devices, such as vertical ladder intermediate pieces, in order to compensate in a simple manner the individual distances of the connection between the assemblies which are not individually adapted to one another of various tower segments and not individually adapted to one another of various construction types.

In particular according to a preferred embodiment, the tower segments $A_i$, $B_m$, $C_n$ of the tower have in the interior premounted, non-individualized assemblies designed as linear components, which are connected to one another using assembly length adapters. Here, the linear assemblies are advantageously smaller and/or shorter in length than the length of the respective tower segments $A_i$, $B_m$, $C_n$ of the tower and/or than the tower segments $A_i$, $B_m$, $C_n$ of the tower.

Assembly length adapters refer to connection pieces, such as rail connection pieces or vertical ladder intermediate connection pieces, which compensate the individual distances between non-individualized assemblies in a simple manner, in particular in the connection area of two tower segments. In particular, a length compensation of up to 200 mm (7.88 in.), especially preferably of 100 mm (3.94 in.) is made possible by the inventive assembly length adapter.

Preferably, the tower segments $A_i$, $B_m$, $C_n$ have premounted vertical ladders, preferably in the interior, where the vertical ladders of the tower segments are connected to each other during the erection of the tower using means of vertical ladder length compensation, such as an intermediate ladder piece described below. In particular, the tower is designed with one or more vertical ladder intermediate pieces near the connections of the tower segments.

Furthermore, in one embodiment it is advantageous that the tower segments $A_i$, $B_m$, $C_n$ have premounted means of conducting current, preferably in the interior, where the means of the tower segments of conducting current are connected to each other when erecting the tower using means of current cable length compensation, such as a (power rail) rail connection piece described below or the like. In the embodiment of the tower, the means of conducting current are connected to each other as power rails near the connections of the tower segments.

In one embodiment, the tower of a wind power plant is or will be constructed from multiple tower segments, where two tower segments will be or are connected to one another in a shared connection area, where a first tower segment and a second tower segment each have a vertical ladder in the interior, each of which has at least one ladder stile and multiple step treads, where upon connection of the first tower segment with the second tower segment, in the connection area the ladder stile or the ladder stiles in the first tower segment are at a distance from the ladder stile or the ladder stiles in the second tower segment, where preferably upon erecting the tower or during the assembly of the tower segments in the connection area of the tower segments, the ladder stile or the ladder stiles of the first tower segment will be or are connected to the ladder stile or the ladder stiles of the second tower segments using a vertical ladder intermediate piece bridging the connection area.

The invention is based on the further idea that tower segments with vertical ladders premounted in the interior of the tower segment are provided, in which the vertical ladder ends do not extend past the ends of the tower segment, but rather are set back toward the inside with reference to the ends of the tower segment. That means that the length of a vertical ladder of a tower segment is less than the outer length of a tower segment and/or less than the height and/or length of a tower segment. Here, the vertical ladder is premounted accordingly in the tower segment before the tower is erected, where the vertical ladder itself can be constructed of multiple individual ladders which extend between the ends and/or the end flanges of a tower segment. The vertical ladder of a tower segment is in particular attached with corresponding means of attachment and/or brackets on the interior wall of the tower and/or of the tower segment essentially parallel to the longitudinal axis of the tower segment and/or along the tower wall in the interior of the tower segment.

Preferably the tower is constructed of a plurality of tower segments of individual tower segments arranged one upon the other and aligned with each other, where the tower segments preferably will be or are connected to each other via flange connections. In particular, the tower segments consist of pipe segments made of steel.

The fact that a prefabricated tower segment is provided with a vertical ladder which does not extend past the ends of the tower segment simplifies the transport of the tower segment from the place of manufacture to the construction site of a wind power plant on one hand, because the vertical ladder in the interior of the tower segment is protected against mechanical stresses during transport. Furthermore, the assembly of a tower and/or tower segments at the construction site is simplified, because the corresponding complementary tower segments which fit one another can be used variably.

For example, according to the state of the art, before the erection of a tower, the corresponding individualized tower segments are equipped with vertical ladders so the corresponding joints of the vertical ladders and flange connections of the tower segments are prespecified exactly. The same tower segments must subsequently be present promptly and nearly at the same time at the construction site of the wind power plant in order to erect the tower efficiently. If, for example, a vertical ladder of an individually adapted tower segment is damaged during transport, the vertical ladder must be repaired with great effort and expense, which delays the construction of a wind power plant.

In contrast to this, according to the invention it is possible to handle in a variable way non-individualized tower segments of the same type and construction, the dimensions of which correspond to one another, i.e. that, for example, any tower segment of this construction and/or this size can be used from a number of multiple tower segments of this type, without it mattering that the tower segments be put together for interior equipping after fabrication at the place of manufacture. Consequently, it is possible to use any tower segment of a particular size with any arbitrary tower segment of another type during the erection of a wind power plant. This improves the handling of tower segments during the erection of a wind power plant.

According to the invention, the length of the vertical ladder is less than the height of the tower segment or the length of the tower segment, so that the ends of the vertical ladder are spaced in each case with predetermined distances with respect to the ends of the tower segment, whereby the ends facing each other of the vertical ladders of two adjacent tower segments connected with one another are at a distance from one another in the connection area and/or flange area. During the erection of the tower, as well during the arrangement of a second tower segment on a first tower segment, whereby a vertically formed tower of a wind power plant arises, the ends facing toward each other of the vertical ladders of tower segments are spaced at a predetermined distance toward each other.

In particular, the height of the rigid vertical ladder intermediate piece is greater than the distance between the ends of the vertical ladders in the tower segments, so that the space between the ends of the vertical ladders is bridged in the connection area of the tower segments and the vertical ladders are connected. Preferably the vertical ladder intermediate piece is used between the vertical ladders of the tower segments during the assembly of the tower and/or upon or during the assembly of the tower segments to be connected to each other.

Another option to install a vertical ladder intermediate piece between the vertical ladders consists of first positioning or aligning the vertical ladder intermediate piece with the upper insertion sleeves and/or beam ends of the intermediate piece in the lower ends of the upper vertical ladder of the upper tower segment and pressing and/or holding the intermediate piece against the lower end of the upper vertical ladder. Subsequently, the lower free end of the vertical ladder intermediate piece is deviated with its lower insertion sleeves and/or beam ends over the beam ends of the lower vertical ladder until the insertion sleeve is positioned and/or aligned above the hollow ends of the beams of the lower vertical ladder of the lower tower segment. After that, the vertical ladder intermediate piece is lowered, preferably vertically, until the vertical ladder intermediate piece rests on the ends of the lower vertical ladder, whereupon after lowering the vertical ladder intermediate piece, the upper insertion sleeves continue to engage in the beam ends of the upper vertical ladder. In this case the lower insertion sleeves are preferably shorter than the upper insertion sleeves. Advantageously, a uniform compensation of length takes place on the lower and on the upper end of the vertical ladder intermediate piece, so that the distance from the lower step tread of the vertical ladder intermediate piece to the upper step tread of the vertical ladder of the lower tower segment is essentially or nearly the same as the distance from the upper step tread of the vertical ladder intermediate piece to the lower step tread of the vertical ladder of the upper tower segment.

Furthermore, within the scope of the invention it is conceivable to connect the vertical ladder intermediate piece with the vertical ladders and/or end beams by means of externally applied sleeves or other clamping devices. Here, the vertical ladder intermediate piece can also be without insertion sleeves, so that the vertical ladder intermediate piece is equal to or smaller than the distance between the ends of the vertical ladders to connect.

Typically, for example, by means of the vertical ladder intermediate piece, which is designed on both ends with insertion sleeves in each case, a maximum connection compensation tolerance length of no more than ±40 mm (1.57 in.) is envisaged. Here the insertion sleeves on both ends of the vertical ladder intermediate piece can compensate a connection compensation tolerance length of 20 mm (0.79 in.), where the length is or will be accordingly limited by preferably design-determined strength requirements.

A vertical ladder intermediate piece of a predetermined length is used here between the end of a vertical ladder of the first tower segment bordering on the connection point and/or the connection area of the tower segments and the end of the vertical ladder of the other and/or second tower segment bordering on the connection point and/or the connection area, whereby the vertical ladders of the tower segments are connected to one another. The provision of the vertical ladder intermediate piece with compensating insertion ends leads to compensation during construction of production tolerances for the (pre-)assembly of the vertical ladders and/or during the production of tower segments in a simple manner when erecting the wind power plant.

In particular, the joints of the tower segments in the connection area, i.e. the flange connection of the tower segments, are bridged in a simple manner by means of the vertical ladder intermediate piece, with the (length) production tolerances (of length) of the premounted vertical ladders as well as of the tower segments compensated by the vertical ladder intermediate piece. In particular, tower segments are used which have vertical ladders with ladder stiles and step treads, where the ends of the vertical ladders do not extend out of the tower segment after pre-assembly.

The total length of a vertical ladder in a tower segment thereby is less than the length and/or height of a tower segment. Preferably the tower segments are in each case provided with flanges or flange rings on their ends, whereby a stable, durable connection is produced in a simple manner via a flange connection formed in the connection area of the tower segments so that after arranging a segment on a tower segment already erected, threaded bolts are set in the bore holes of the flanges or flange rings and tightened together. Here the flange connection constitutes the connection area between the tower segments. Preferably, the vertical ladders are made of a light material, such as aluminum or suchlike.

Consequently, in accordance with the invention, a simple length tolerance compensation of premounted parts is enabled by the inventive vertical ladder intermediate piece, which is used between the ends to be connected to each other of the vertical ladders of the tower segments.

Moreover, one development of the tower is distinguished in that the vertical ladder intermediate connection piece will be or is arranged between the vertical ladders of the tower segments without attachment, i.e. without contact to the flange connection of the tower segments and/or without attachment to the tower segments or the connection area of the tower segments. Here the vertical ladder intermediate piece has only (connecting) contact with the ends of the vertical ladders of both tower segments connected to each other.

Furthermore, according to an advantageous embodiment, load forces acting on the vertical ladder intermediate piece, for example from a maintenance person on the vertical ladder intermediate piece, are or will be diverted to the lower vertical ladder and/or to the upper vertical ladder, so that in the connection area of the tower segments bridged by the vertical ladder intermediate piece, the forces acting on the upper and/or lower vertical ladders are absorbed in a distributed manner.

Moreover, by means of the vertical ladder intermediate piece, in particular in the condition arranged between the vertical ladders, length tolerances of up to 200 mm (7.88 in.), in particular of up to 100 mm (3.94 in.), more preferably of up to 40 mm (1.57 in.), and/or lateral tolerances of up to 200 mm (7.88 in.), in particular of up to 100 mm (3.94 in.), more preferably of up to 50 mm (1.97 in.) are or will be compensated in the vertical direction for assembled tower segments, i.e. those connected to each other.

Preferably the vertical ladders have at least one, preferably two, ladder stiles, where the ladder stiles consist of hollow sections. In addition to that, the vertical ladders also have correspondingly formed step treads that are cross-directional, in particular perpendicular to the ladder stiles.

Furthermore, in one development it is envisaged that the first tower segment and/or the second tower segment be provided with flanges and/or flange rings on their ends, where the flanges extend in a circular ring-shaped manner and preferably externally flush with the individual tower segments.

Preferably, the vertical ladder intermediate piece has at least one crossbeam as a step tread, where the vertical ladder intermediate piece has corresponding connection beams between the ends of the vertical ladders to be connected to one another in the tower segments.

In addition to that, in a further embodiment of the tower, it is envisaged that the vertical ladder intermediate piece connect the ladder stile or the ladder stiles of the vertical ladders of the first and second tower segment, with the vertical ladder intermediate piece having on one side, preferably on both sides, beam connection pieces which will be or are inserted in the hollow beams and/or beam ends of the vertical ladders of the tower segments.

Preferably, length tolerance compensation takes place between the lower step tread of the vertical ladder intermediate piece and upper step tread of the lower vertical ladder and/or between the upper step tread of the vertical ladder intermediate piece and lower step tread of the upper vertical ladder with a vertical ladder intermediate piece arranged between the vertical ladders. In one embodiment in particular, a preferably uniform length tolerance compensation can occur at the same time in the lower area and in the upper area of the vertical ladder intermediate piece, so that the compensated tolerances are distributed. Compensation spacers or the like can be used for this purpose.

In order to develop and/or achieve vertical anchorage of the vertical ladder intermediate piece, according to one embodiment the vertical ladder intermediate piece inserted between the vertical ladders of the tower segments is permanently connected to the ladder stiles of the vertical ladders. This can take place by bolting the ends of the vertical ladders to the ends of the intermediate piece. Furthermore, the parts can be connected by inserting cotter pins or suchlike in drilled or provided holes.

Moreover, within the scope of the invention it is envisaged that the distance between the end of a tower segment, which is arranged downward upon erection of a tower, and the end of the vertical ladder at this end of the tower segment is always constant. This facilitates the production and/or pre-assembly of vertical ladders in the tower segments in a simple manner. Moreover, the ends of the vertical ladders on the upper end of the tower segments can also be constructed or arranged accordingly at a predetermined distance to the end of the upper tower segment.

Furthermore, the tower segments and/or tower walls of the erected towers are cylindrical or circular in construction. In addition to that, the tower segments, especially from the lower to the upper end of the tower segment, are constructed in a conically tapered manner.

Moreover, in one embodiment of the tower, it is envisaged that the vertical ladder of the first tower segment and/or the vertical ladder of the second tower segment have a fall protection rail which is essentially the same length as the corresponding ladder stiles of the vertical ladders. In particular the fall protection rail, which essentially runs parallel to the ladder stiles of the vertical ladders, is for protecting persons who ascend a wind power plant. In addition to that, a fall protection rail of the vertical ladder intermediate piece is or will advantageously fit between the ends to connect the fall protection rail of the first and/or of the second tower segment and/or the corresponding vertical ladders, in order to connect the fall protection rails of the vertical ladders accordingly to one another. The length adjustment of the fall protection rail of the vertical ladder intermediate piece can be performed appropriately in a manual way in this process.

In addition, in one development it is envisaged that the length of the preferably premounted vertical ladders of the first and/or of the second tower segment is less than the length and/or height of the first and/or second tower segment, so that the ends of the vertical ladder are arranged and/or terminate within the tower segments at a predetermined distance with respect to the ends of the tower segment in each case.

Furthermore, according to a further aspect of the invention, the tower is or will be constructed from multiple tower segments, where two tower segments will be or are connected to each other in a shared connection area, where a first tower segment and a second tower segment each have a rigid power rail in the interior, where upon connection of the first tower segment with the second tower segment in the connection area, the power rail in the first tower segment is spaced apart from the power rail in the second tower segment, said tower being further developed in that the power rail of the first tower segment and the power rail of the second tower segment will be or are connected to one another through the use of a rail connection piece bridging the connection area of the tower segments and adaptable in its length, in particular able to be set variably in length.

Here, invention is based on the further idea that the premounted power rails in the interior of the tower segments are shorter in length than the height and/or length of a tower segment, so that the ends of the power rail not do not extend from the tower segment and consequently are fastened and/or arranged in the interior of the tower segments. This way it is possible to equip tower segments with power rails in the interior during their production, to transport the tower segments subsequently after (pre-)assembly to the construction site of wind power plants without the power rails being able to be damaged during transport.

The power rails themselves are attached here in the interior of the tower segments using appropriate attachment devices. Electrical energy produced by a generator in the nacelle on the tower of the wind power plant is transferred via the power rails to a power module or the grid connection outside of the wind power plant.

The fact that the power rails end at a predetermined distance with respect to the ends of the tower segments results in a distance between the power rails of the two connected tower segments after connection of the tower segments with the power rails and/or their power rail segments, where using a rail-like rail connection piece, which is adjustable in length, between the two power rails produces a preferably essentially linear connection in the connection area of the tower segments. The inventive linear rail connection piece is thereby variably adaptable and/or adjustable in a simple manner in its length in order to compensate and/or adapt to variances in distance between the two opposing ends of the power rails of the first and second tower segment. Here the inventive means of rail connection bridges the connection area and/or the flange connection area of both tower segments; after its integration between the two ends of the power rails to connect, the rail connection piece is securable and/or secured and is consequently rigid in construction. In particular, the rail connection piece is variably adaptable thereby in its length in a linear direction. Preferably the length of the rail connection piece is adjustable and securable between a minimum and a maximum.

Moreover, the invention has the advantage that tower segments with power rails are premounted at the production location of the tower segments, where a predetermined spacing is maintained and/or constructed between the ends of the tower segments and the ends of the power rails and/or power rail segments in the corresponding tower segment. Altogether, this likewise results in a simple handling of tower segments, because tower segments of a particular (construction) type and/or a particular geometry are provided, which can be selected and/or specified together arbitrarily and in a complementary manner with corresponding tower segments of another type for erecting a tower; it is no longer mandatory that the length of the power rails within the tower segments be produced in a one-to-one manner for complementary function with one another. This also simplifies the manufacturing processes of tower segments with power rails.

Altogether the total length of the power rails and/or power rail segments in a tower segment is less than the length or height of the corresponding tower segment.

To do this, it is further envisaged that the length of the power rails of the first and/or second tower segment is less than the length of the first and/or second tower segment, so that the ends of the power rail are arranged and/or terminate within the tower segment at a predetermined distance with respect to the ends of the tower segment.

Moreover, according to a further embodiment of the tower it is envisaged that the power rail connection piece have at least two rail pieces which are designed as detachably slidable, preferably linearly, with one another and/or opposed to one another.

To do this it is particularly envisaged that at least one rail part of the power rail connection piece has a slot hole, preferably in a linear sliding direction. The other rail part has a connection element here, which extends through the slot hole of the other rail piece, enabling reliable guiding and/or repositionability of both rail parts against each other. After attaching the rail parts with the power rails, the rail parts of the power rail connection piece are, for example, secured against one another by a bolt which extends through the slot hole of the one rail part or through the slot holes of the rail parts to ensure no slippage by tightening the bolt.

The reliability of electrical transmission is ensured by tensioning the bolt with a predetermined torque. For multiple power rails of a rail package inventive rail connection pieces are envisaged in each case, in which isolators are provided between two inventive rail connection pieces. Here a bolt can extend through multiple slot holes of rail parts; advantageously the bolt is isolated with respect to the slot holes. This can occur, for example, in that the bolt is provided with at least two (isolating) sleeves, which are slidable against one another and/or fit into each other, which are penetrated by the bolt.

Furthermore, in a preferred embodiment it is envisaged that at least one rail part has an offset with which a space-saving arrangement is achieved for the rail parts of the power rail connection piece between the two power rails to connect.

If several power rails of a rail package in a tower segment are to be connected with the corresponding power rails of another rail package in the second tower segment using a rail connection piece in each case, the rail parts with an offset can be offset to varying extents. For example, the inner rail parts of multiple rail connection pieces arranged parallel and adjacent to each other can be offset less than the outer rail parts with an offset. Therefore, in the connection area to bridge, the arrangement of multiple adjacently placed rail connection pieces can be designed thicker for power rails of (power) rail packages to connect compared to the parallel oriented power rails of the rail packages. An encasement covering the rail connection pieces is therefore also correspondingly expanded and/or broadened in construction in the connection area.

Furthermore, the tower is advantageously further developed in that means of connection are provided for connecting the rail connection piece and/or rail parts with the power rails.

Furthermore, the object is solved by the use of vertical ladders during or for the erection of a tower of a wind power plant, in which the tower is or will be constructed as described above. To avoid repetition, explicit reference is made to the exposition above.

In addition to that, the object is solved by a use of power rails in a tower of a wind power plant as well as during or for the erection of a tower, in which the tower is constructed as above with a power rail system. To avoid repetition, explicit reference is made to the exposition above.

Furthermore, the object is solved by a tower of a wind power plant in which the tower is or will be constructed from multiple tower segments, where the tower is or will be erected according to the method described above.

Within the scope of the invention, it is self-evident that the rail parts and/or power rail connection piece are electrically conductive in order to thus conduct current through the connected power rails of the tower segments. Typical power rail systems used in wind power plants are, for example, rail distribution systems with the designation "BD" or "LD" from Siemens.

According to the proposed inventive solutions, both with the use of a vertical ladder intermediate piece and/or a power rail connection piece in the connection area and/or in the flange area of two tower segments linearly elongated components extending along the tower walls of the wind power plant towers are bridged in a simple manner, where the distance between the ends of the linear components to connect is bridged in a simple manner and at the same time compensation of length or compensation of length tolerance occurs in a linear direction of the components. Here the linear components are premounted after the production of the tower segments, whereby the linear components do not extend out of the tower segments and consequently, for example, can be damaged during transport of the tower segments to the construction site.

In addition, to that the tower segments can be used and/or included as desired and not only for a single tower and/or during its construction, so that, for example, any tower segment of a particular design can be connected in a complementary manner with another tower segment of a different design and it is, thus, no longer necessary that only two exactly predetermined, individual matched tower segments be connected to one another. Rather, in accordance with the invention, it is possible that any tower segment with a premounted, linearly arranged vertical ladder and/or a premounted, linearly arranged power rail can be connected, where this second tower segment also has a premounted vertical ladder and/or a premounted power rail.

Further characteristics of the invention are apparent from the description of inventive embodiments together with the claims and drawings included. Inventive embodiments can fulfill individual characteristics or a combination of multiple characteristics.

BRIEF DESCRIPTION OF THE DRAWINGS

The invention is described below based on embodiments without restricting the general intent of the invention; explicit reference is made to the figures with regard to all inventive particulars not explained in more detail in the text. These show in FIG. 1 a schematic representation of a wind power plant.

DETAILED DESCRIPTION OF THE INVENTION

In the figures that follow, in each case the same or similar elements or corresponding parts bear the same reference numbers so that a corresponding redundant presentation is avoided.

Figure 1:
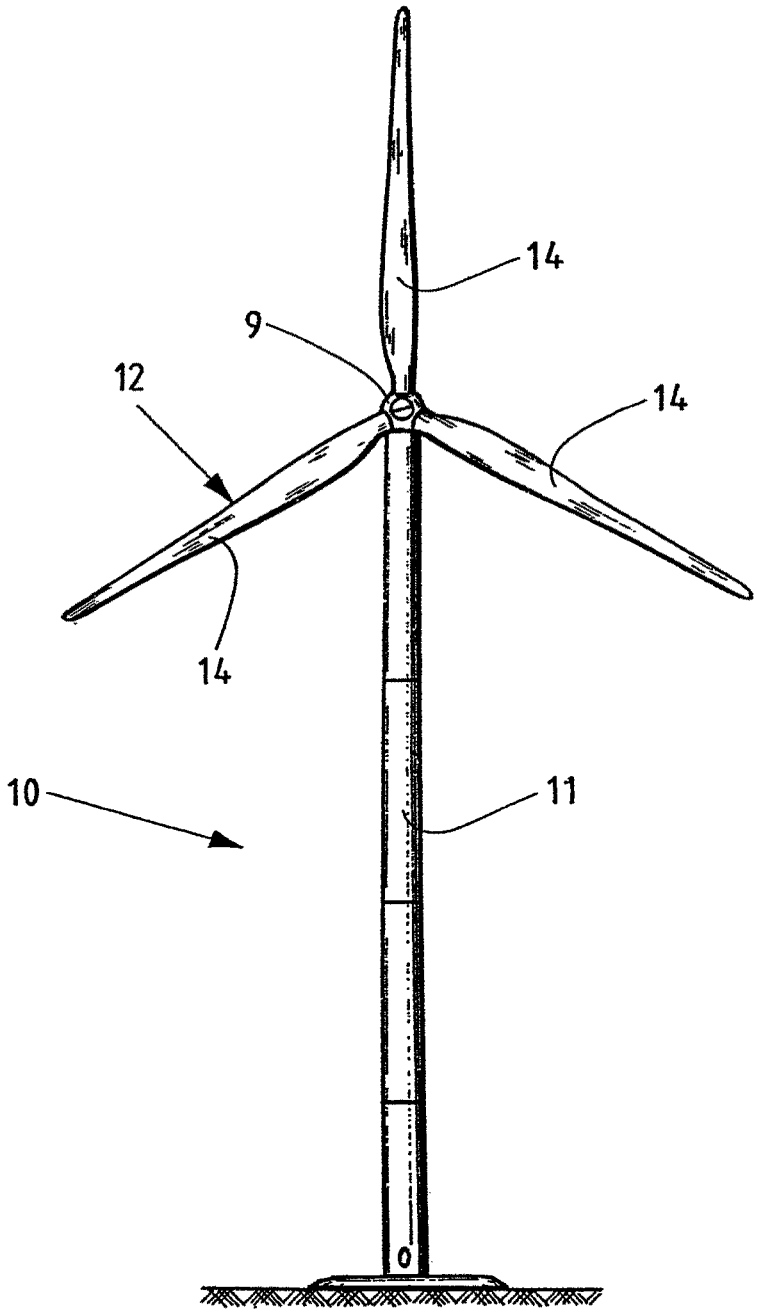

FIG. 1 shows a schematic representation of a wind power plant 10. The wind power plant 10 has a vertically oriented tower 11 and a rotor 12, which includes three rotor blades 14 which are attached on a rotor hub 9. Upon the incidence of wind, the rotor 12 turns in a known manner. By this means power can be produced by a generator connected to the rotor 12 and/or to the rotor hub 9 in a nacelle on the tower 11 and delivered to the consumer grid.

The tower 11 is constructed here as a tubular steel or steel shell tower and consists of multiple tubular tower sections connected to one another. The tubular tower sections are also designated as a tower section, so that a tubular tower is constructed as a multi-section tubular tower.

In the embodiment of a wind power plant 10 shown in FIG. 1, the tower 11 consists of multiple tower segments which essentially share the same design. Preferably the tower segments consist of hollow cylindrical tube sections made from correspondingly suitable steel, where each cylindrical tower segment can taper conically from the bottom toward the top. Each of the tower segments has an integrated, closed, hollow cylindrical tower wall which extends from the flange of a tower segment to an upper flange of the tower segment, where the flanges of the tower segments are essentially ring-shaped in design and extend starting from the tower wall inward into the interior space of the tower segments.

Figure 2:
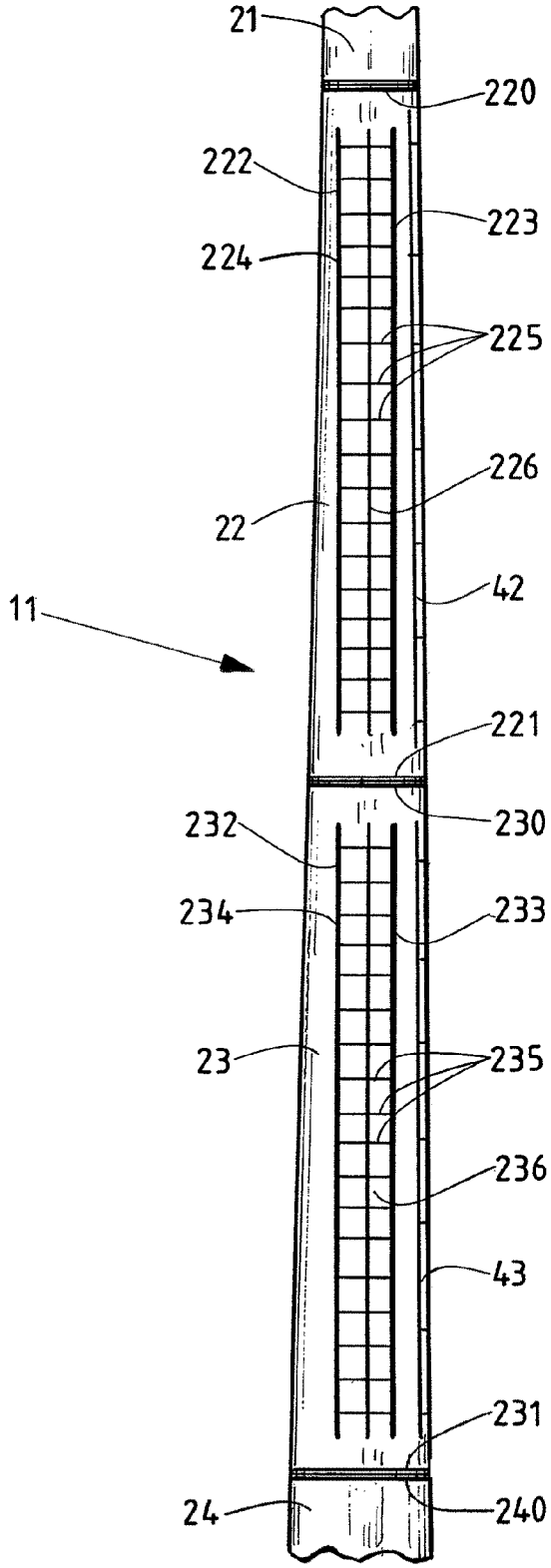
FIG. 2 a schematic interior view of a tower section of a tower of a wind power plant in cross section.

FIG. 2 schematically shows a tower section of a wind power plant tower 11, in which the tower 11 is constructed from multiple tower segments 21, 22, 23, 24. For example, the tower segment 22 has on the upper end an end flange 220 and on the underside a flange ring 221 at the end. The tower segment 23 arranged under the tower segment 22 has an upper-side flange ring 230 and a lower side flange ring 231. The flange ring 231 of the tower segment 23 is connected with a flange ring 240 of the lower tower segment 24, while the upper flange ring 230 of tower segment 23 is connected with the lower flange ring 221 of tower segment 22. On the upper-side of the flange ring 220 of tower segment 22, the flange ring 220 is connected with a flange ring 211 of the upper tower segment 21.

In the interior of the tower 11 vertical ladders 222, 232 are attached to the interior wall of the tower in the respective tower segments, for example in the tower segments 23 and 22. For vertical ladders, corresponding means of attachment to interior walls of towers are known to the specialist.

The vertical ladder 222 of the tower segment 22 is smaller and/or shorter than the length of the tower segment 22, so that the vertical ladder 222 is premounted between the flange rings 220 and 221 during production of the tower segment 22. Here, the ends of the vertical ladder 222 do not extend beyond the flange rings 220 and 221. This also applies in a corresponding manner to the vertical ladder 232, which is arranged on the interior tower wall of the tower segment 23.

The vertical ladders 222 and 232 of the tower segments 22 and 23 have elongated ladder stiles, between which step treads 225 and/or rungs are arranged at regular intervals. Accordingly, the vertical ladder 232 has step treads 235 arranged between the ladder stiles 233, 234 running lengthwise to the flange rings 230 and 231. A fall protection rail 226 runs between the ladder stiles 223, 224 of the vertical ladder 222 as a fall protection safeguard for persons. The fall protection rail of the vertical ladder 232 has the reference number 236.

The ladder stiles 223, 224, as well as 233, 234 are preferably constructed as hollow sections formed and preferably made of aluminum. The ladder stiles 223, 224, as well as 233, 234, of the vertical ladders 222, 232 terminate at predetermined distances from the upper and lower flange rings 220, 221 as well as 230, 231 of the corresponding tower segments 22 and/or 23, so that, for example, the upper ends of the ladder stiles 233, 234 of the vertical ladder 232 (in the tower segment 23) are at a distance from the lower ends of the ladder stiles 223, 224 of the vertical ladder 222 (in the tower segment 22). Here the ends of the vertical ladders 222, 232 are at a distance from the connection area of the tower segments 22, 23, with the connection area formed by a flange connection of the flange rings 221, 230.

Figure 3:
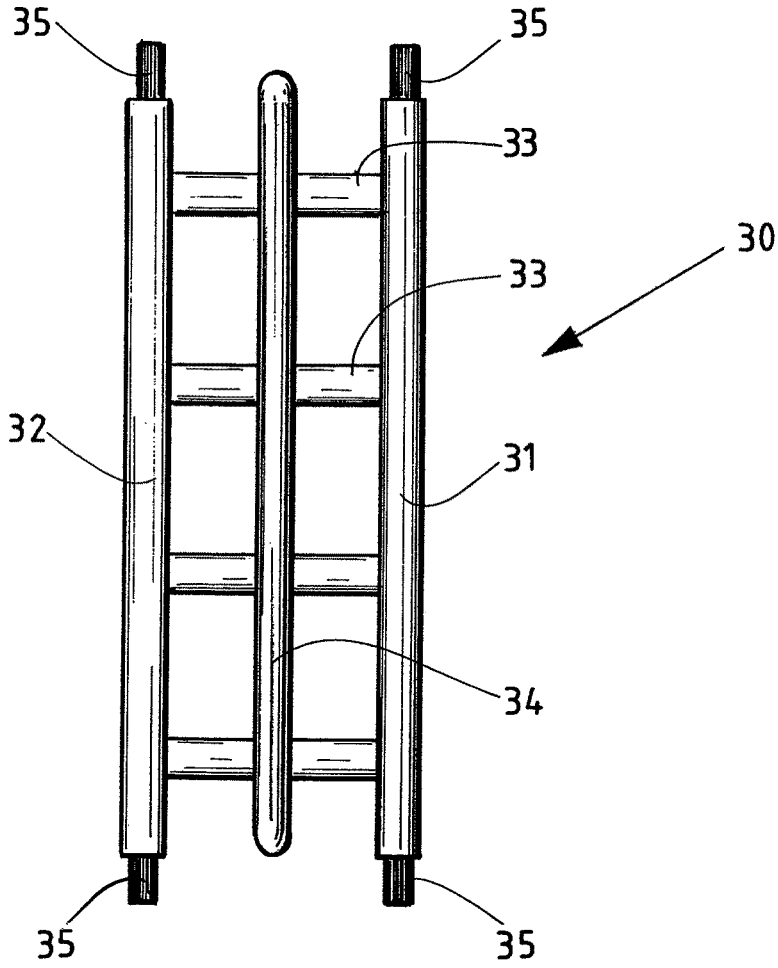
FIG. 3 a schematic view of an inventive vertical ladder intermediate connection piece.

When the tower is erected, i.e. during the placement of tower segment 22 on tower segment 23, for example, a vertical ladder intermediate piece is inserted between the ladder stiles 233, 234 of the vertical ladder 232 and the lower ends of the ladder stiles 223, 224 of the vertical ladder 222, as shown in FIG. 3, for example. The two vertical ladders 222, 232 are connected to one another by the arrangement of the vertical ladder intermediate piece 30 (FIG. 3) between the vertically oriented vertical ladders 222, 232 and/or their ends, where at the same time by the arrangement of the vertical ladder intermediate piece the production-related length differences are compensated between the ends of the vertical ladders to be connected for any two tower segments and/or of two premounted vertical ladders of two tower segments.

FIG. 3 is a schematic representation of an inventive vertical ladder intermediate piece 30, in which the vertical ladder intermediate piece 30 has two parallel ladder stiles 31, 32 running parallel to one another, between which rung-like step treads 33 are arranged. A fall protection rail section 34 is arranged between the ladder stiles 31, 32. Beam connection pieces 35 are fitted on the upper and lower ends of the vertical ladder intermediate piece and secured, for example, with screws or suchlike in the ladder stiles 31, 32, where during the erection of the tower, the beam connection pieces 35 are inserted in the hollow ladder stiles 223, 224 and/or 233, 234 of the vertical ladders 222 and/or 232 and/or their hollow ladder stile ends. The fact that the beam connection pieces 35 are arranged on the ladder stiles 31, 32 means that the length of the vertical ladder intermediate pieces is greater than the distance of the end of two vertical ladders to be connected to one another.

The production tolerances during the pre-assembly of vertical ladders on and/or in the tower segments are compensated in a simple manner by the extension of the ladder stiles 31, 32 by arrangement of the beam connection pieces 35 in the hollow ladder stiles 31, 32 of the vertical ladders of the tower segments, whereby in particular the ends of the vertical ladders, which are located below during the arrangement of a tower segment on another tower segment, always terminate and/or begin and/or are arranged at the same distances from the lower ends and/or the lower flange rings of the tower segments.

The length tolerances are compensated by the use of the inventive vertical ladder intermediate piece 30 between two vertical ladders in the connection area of two tower segments during assembly and/or erection of a tower of a wind power plant, whereby it is also possible to select any tower segment of a particular construction, since all tower segments of this construction have a vertical ladder, the ends of which are arranged at a predetermined distance to a premounted vertical ladder and/or at a defined distance from the lower flange ring. Easier handling of the tower segments results from this.

Simplified handling of the vertical ladder intermediate piece 30 when erecting a tower of a wind power plant also results from the fact that the vertical ladder connection piece 30 connects only the ladder stiles of the vertical ladders to each other, whereby the vertical ladder intermediate piece bridges the connection area of the tower segments and in the connection area of two tower segments has no contact with the interior wall in the area of the connection of tower segments.

As is further apparent from FIG. 3, the vertical ladder intermediate piece 30 also has a fall protection rail section 34 between the ladder stiles 31, 32, the length of which is adapted appropriately, preferably manually, upon connection of two vertical ladders of two tower segments. The fall protection rail of the vertical ladders in the tower segments are connected by means of the fall protection rail section 34. For example, during the assembly of two tower segments, the fall protection rail section 34 is adapted on site by cutting to length using a linear measure, such as a folding rule or the like, and sawing by fitters to the exact installation measurement.

FIG. 2 is also shows that the tower segments 22, 23 along the inner tower walls of the tower segments have power rails 42, 43 running linearly, which are attached to the interior side of the tower wall with corresponding means of attachment. The power rails 42, 43 terminate like the vertical ladders 222, 223 at predetermined distances with respect to the corresponding flange rings 220, 221 as well as 230, 231 and/or ends of the tower segments 22, 23. The power rails 42, 43 are oriented thereby as linear and/or linear-running components, so that the electrical energy produced in a generator in the nacelle on the tower is transferred to a power module or a consumer by means of the power rails. Here the power rails 42, 43 are preferably premounted during the production of the tower segments 22, 23, so that the segmented power rails 42, 43 are arranged premounted in the tower segments 22, 23. The ends of the power rails 42, 43 do not extend past the ends of the tower segments 22, 23 in this.

Figure 4B:
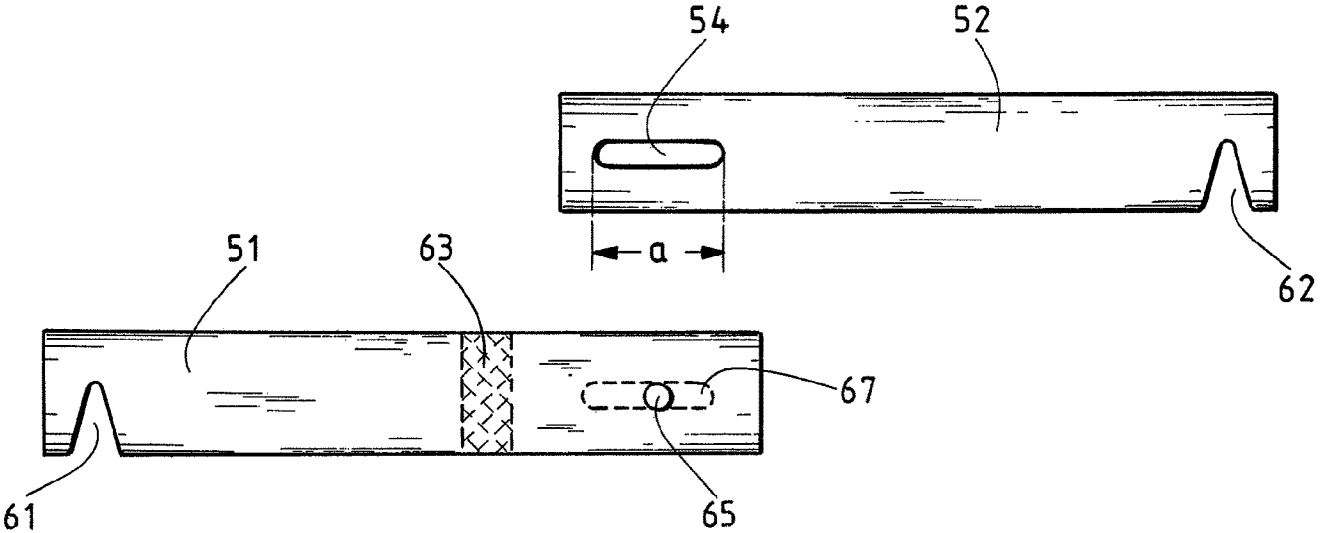
FIG. 4*a*, 4*b* various schematic views of a power rail connection piece.
Figure 4A:
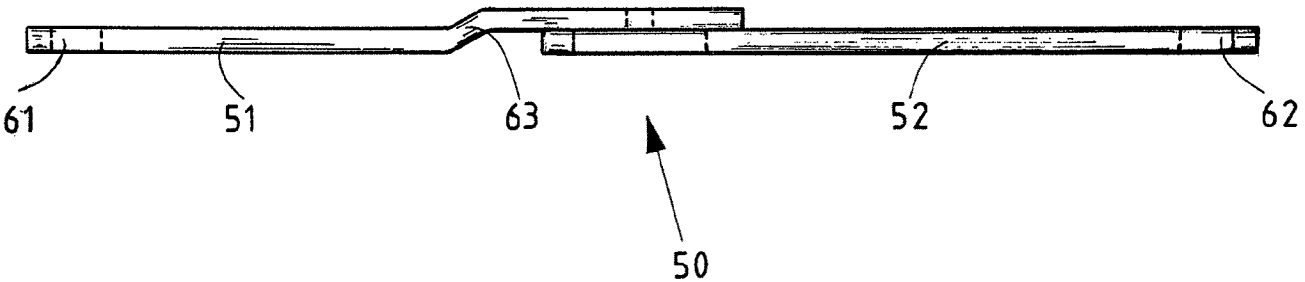

According to the invention, for connecting the power rails 42, 43 non-bendable rail connection pieces which are adaptable in length are envisaged, as shown in FIGS. 4*a* and 4*b*, for example.

FIG. 4*a* shows a top view of an inventive rail connection piece and FIG. 4*b* shows the rail parts of the rail connection piece in a lateral view.

FIG. 4*a* shows an inventive rail connection piece 50 consisting of two straight, inflexible, i.e. rigid rail parts 51, 52, where groove-like depressions 61, 62 are formed in the outer end areas of the rail parts 51, 52, which are brought in contact with the power rails in the tower segments. The rail part 51 has a bent form on the other side with an offset 63, so that end of the rail part 51 facing away from the recess 61 is arranged parallel to the linear rail part 52. The rail part 52 has on the outer side, which faces toward the other rail part 51, a slot hole 54 with a predetermined length a, which is penetrated by an attachment bolt 65 of the rail part 51. The length a of the slot hole 54 can be formed between 10 mm and 100 mm, preferably between 20 mm and 80 mm, further in particular between 20 mm and 50 mm.

An attachment bolt 65 is arranged on the side of the rail part 51, which is attached to the other rail part 52 corresponding with the rail part 51. Due to the offset 63 as well as the slot hole 54, rail parts 51, 52 are slidable against one another in a linear direction so that with use of the rail connection piece 50 made from the two rail parts 51, 52 the power rails 42, 43 are connected to one another in the connection area of the tower segments 23, 22 (see FIG. 2) in the area of their flange rings 221, 230, whereby the rail connection piece 50 bridges the connection area of two tower segments directly without contact with the tower walls or the flange rings of the connection area, and the power rails are connected.

As an alternative, the rail part 51 can also have a slot hole. This slot hole is drawn dashed in FIG. 4*b* for the rail part 51 and assigned the reference number 67.

The fact that the rail parts 51, 52 are slidable against one another in a linear direction means that the distance between the two power rails 42, 43 can accordingly be adjusted and/or compensated in length in a simple manner. After connecting the two power rails 42, 43, the attachment bolt 65 is tightened, which achieves a stable, fixed setting of the rail parts 51, 52.

Figure 4D:
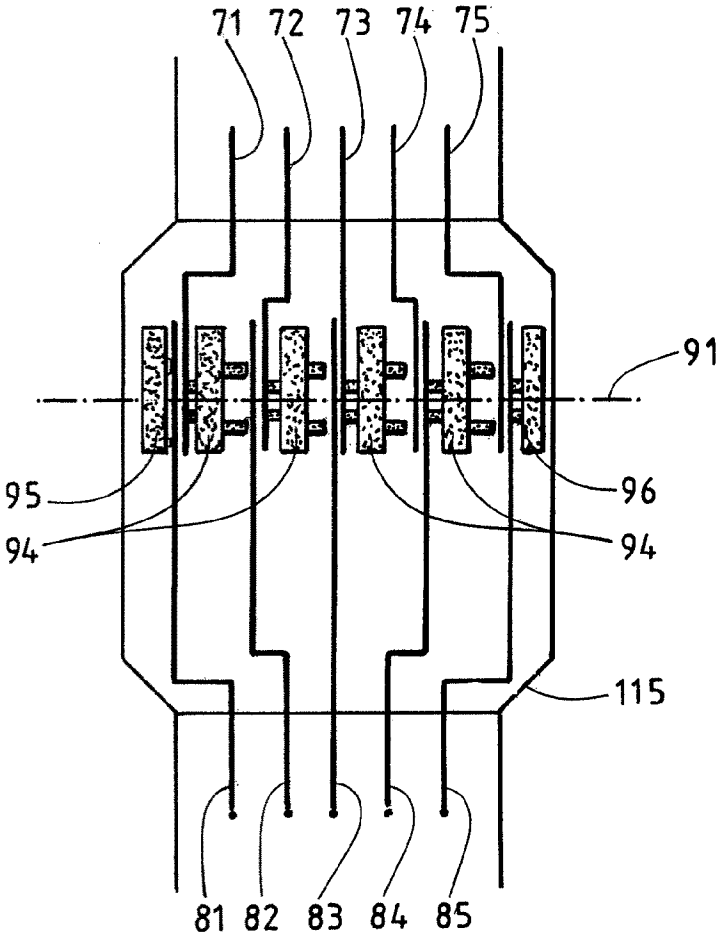
FIG. 4*c*, 4*d* a schematic connection of multiple power rail parts in each case.
Figure 4C:
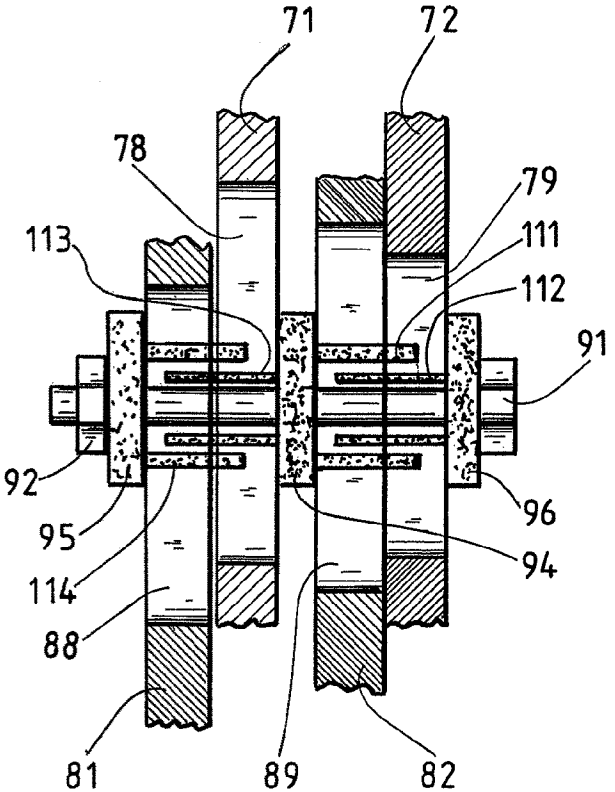

FIG. 4*c* shows schematically a cross section of the connection area of multiple rail parts 71, 72 and 81, 82 and/or power rails. Here the rail part 71 and rail part 81 are connected with one another and rail part 72 with rail part 82, in touching contact in each case, in order to produce an electric contact between the rail parts 71 and 81 as well as between the rail parts 72 and 82. Both the rail parts 71, 72 as well as the rail parts 81, 82 have corresponding slot holes 78, 79 and/or 88 and 89, which are penetrated by a bolt 91 and/or a connecting bolt, where by tightening an external nut 92 on the bolt 91 the rail parts 71, 81 and rail parts 72 and 82 arranged in between will be and/or are tightened.

In order to electrically isolate from one another the electrically conductive rail parts 71, 81 from the other rail parts 72, 82 in contact with each other, an isolator 94 is arranged between the rail part 71 and the rail part 82. In addition to that, on the outer sides of the rail parts 81 and 72 isolators 95, 96 are also provided, in order to insulate the rail packages 71, 81 and 72, 82 from one another. Furthermore, the middle isolator 94 has an outer sleeve 111, which an inner sleeve 112 of the external isolator 96 engages. Furthermore, the isolator 94 has on the side facing away from the outer sleeve 111 an isolating inner sleeve 113, which is surrounded by an isolating outer sleeve 114 of the isolator 95. The bolt 91 penetrates the rail parts 71, 72 as well as 81 and 82, where the bolt 91 is electrically isolated from the electrically conductive rail parts 71, 72, and 81, 82 by the outer and inner sleeves 111, 112, 113, 114, which it also penetrates, of the isolators 94, 95 and 96.

FIG. 4*d* shows schematically in cross section the connection of multiple rail parts 71, 72, 73, 74 and 75 with electrically conductive rail parts 81, 82, 83, 84, 85, where the rail parts are penetrated crosswise by a schematically drawn bolt 91. Between the rail part pairs 71, 81 as well as 72, 82 and 73, 83 and 74, 84 and 75, 85 isolators 94 are arranged in each case, which have isolating inner and outer sleeves for the bolt 91 and penetrate slot holes of the rail parts. Furthermore, there are isolators 95, 96 arranged on the outer sides of the rail combination.

The rail parts 71, 72 as well as 74, 75 have offsets in the connection area, while the rail part 73 is not offset and/or is straight in form. Accordingly, the rail parts 81, 82, 84 and 85 are likewise offset in the connection area, while the rail part 83 arranged in the middle is not offset and/or is straight in form. Through the use of variously offset rail parts, it is possible to connect to one another in a simple manner multiple rail parts in the interior of a tower in the connection area and/or the flange connections of the tower segments, where the area of the rail parts and/or power rails to connect to each other is broadened compared to the straight power rails and/or power rail packages along the tower segments and is likewise surrounded by a broadened enclosure 115.

The outer rail parts 71, 75 and/or 81, 85 are more offset in the connection area than the rail parts 72, 74 and/or 82, 84 lying inward, so that multiple rail parts of a rail package in a tower segment and the corresponding rail parts of another rail package in a second tower segment are connected to one another in the connection area of the two tower segments. The advantage of this arrangement lies in the fact that the power rails and/or rail parts 71, 72, 73, 74, 75 as well as 81, 82, 83, 84, 85 can be arranged very compactly and only in the connection area must additional installation space be created and/or provided.

Figure 5:
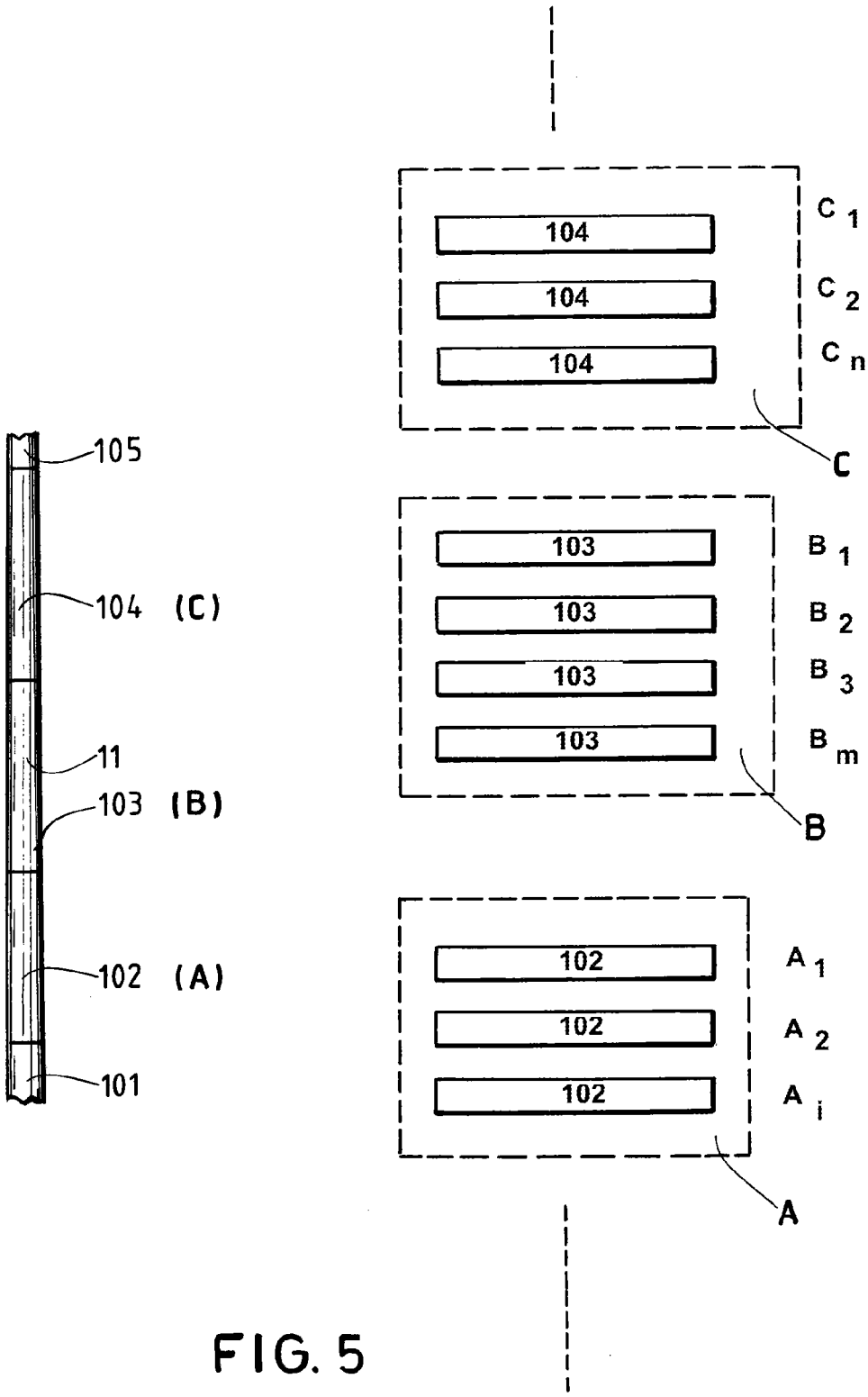
FIG. 5 a schematic representation of a method for erecting a tower of a wind power plant.

FIG. 5 shows schematically how a tower of a wind power plant is constructed from a plurality of non-individualized tower segments. The left area in FIG. 5 shows a section of a wind power plant tower 11 schematically.

This tower 11 is assembled from multiple tower segments 101, 102, 103, 104 and 105, where the tower segments 101, 102, 103, 104 and 105 used for this were not individually adapted to one another during production and prior to assembly of the tower 11. Instead non-individualized tower segments were used.

First, multiple tower segments are produced before the assembly of the tower. Some tower segments of multiple, in particular more than three, construction types are manufactured as tower segments. In FIG. 5 in the right area, there is the example of several reserve inventories A, B, C, or depots shown, in which some tower segments of the corresponding constructions A, B and C are stored and/or provided after their production and before the assembly of the tower. The tower segments of construction A are assigned to the corresponding inventory A, the tower segments of construction B assigned to the corresponding inventory B and the tower segments of construction C assigned to the corresponding inventory C.

The tower segments of the constructions A, B and C are each standardized in design, so there are no individual differences between the tower segments which are due to design. In addition to that, construction A of the tower segments differs from construction B and C. And design B and C also differ, so during the construction of a tower in each case any arbitrary tower segment of design A, in each case any arbitrary tower segment of design B and in each case any arbitrary tower segment of design C, etc. is taken from the corresponding inventories and are provided at the construction site of the tower for the assembly.

For example, an arbitrary tower segment of the standardized construction A was used as tower segment 102, an arbitrary tower segment of the standardized construction B as tower segment 103 and an arbitrary tower segment of the standardized construction C as tower segment 104, where the tower segments preferably have flange rings on their ends so that a flange connection is formed in each case between two tower segments.

Of course further standardized tower segment designs can also be provided as part of the invention.

The tower segments of the standardized constructions A, B and C can furthermore have assembly units or devices, such as vertical ladders and/or power rails, in the interior, which must be connected to one another. In order to connect these assemblies running and/or arranged along the tower wall, means of connection are used which can be set and are variable in connection length and/or compensate length tolerance, so that the individual adjustment of a tower constructed from standardized and/or non-individualized tower segments ensues using the means of connection.

All characteristics described, also those to be taken solely from the drawings as well as individual characteristics which are disclosed in combination with other characteristics, are considered important for the invention singly and in combination. Inventive embodiments can be fulfilled by individual characteristics or a combination of multiple characteristics.

LIST OF REFERENCES

9 Rotor hub
10 Wind power plant
11 Tower
12 Rotor
14 Rotor blade
21 Tower segment
22 Tower segment
23 Tower segment
24 Tower segment
30 Vertical ladder intermediate piece
31 Ladder stile
32 Ladder stile
33 Step tread
34 Fall protection rail section
35 Beam connector
42 Power rail
43 Power rail
50 Rail connection piece
51 Rail piece
52 Rail piece
54 Slot hole
61 Recess
62 Recess
63 Offset
65 Attachment bolt
67 Slot hole
71 Rail piece
72 Rail piece
73 Rail piece
74 Rail piece
75 Rail piece
78 Slot hole
79 Slot hole
81 Rail piece
82 Rail piece
83 Rail piece
84 Rail piece
85 Rail piece
88 Slot hole
89 Slot hole
91 Bolt
92 Nut
94 Isolator
95 Isolator
96 Isolator
101 Tower segment
102 Tower segment
103 Tower segment
104 Tower segment
105 Tower segment
111 Outer sleeve
112 Inner sleeve
113 Inner sleeve
114 Outer sleeve
115 Enclosure
220 Flange ring
221 Flange ring
222 Vertical ladder
223 Ladder stile
224 Ladder stile
225 Step tread

226 Fall protection rail
230 Flange ring
231 Flange ring
232 Vertical ladder
233 Ladder stile
234 Ladder stile
235 Step tread
240 Flange ring
A Construction of a tower segment
B Construction of a tower segment
C Construction of a tower segment
a Length

The invention claimed is:

1. A method for erecting a tower of a wind power plant made of at least three tube-shaped tower segments, in which a tower segment is connected at a tower segment end with another tower segment in each case, comprising the steps of:

Providing multiple groups of non-individualized tower segments wherein the groups are of varying construction types (indicated by a letter A, B, C) with a number of tower segments in a group (indicated by a subscript letter i, m, n)

wherein the tower segments in a group of a particular construction type are of a standardized design and indistinguishable amongst themselves, but not individually matched or adapted to just one other specific tower segment in another group Arranging tower segments in a predetermined sequence: a tower segment of type A-a tower segment of type B-a tower segment of type C, one upon the other, Wherein in the arranging step the first tower segment, a tower segment of construction type A, is selected arbitrarily from a group having a plurality $i \geqq 2$ of type A tower segments $A_i$ which are constructed in the same way among themselves and exchangeable one for the other, wherein the second tower segment, a segment of the type B, is selected arbitrarily from a group having a plurality $m \geqq 2$ of type B tower segments $B_m$ which are constructed in the same way among themselves and exchangeable one for the other, wherein the third tower segment, a segment of the type C, is selected arbitrarily from a group having a plurality $n \geqq 2$ of type C tower segments $C_n$ which are constructed in the same way among themselves and exchangeable one for the other, wherein the tower segments $A_i$, $B_m$, $C_n$ have linear premounted and non-individualized ladders, in an interior, where the ladders of the tower segments are connected to each other using means of ladder length compensation during the erection of the tower, and wherein the tower segments $A_i$, $B_m$, $C_n$ have linear premounted and non-individualized means of conducting current, in an interior, where the current conducting means of the tower segments are connected to each other using current cable length compensation means during the erection of the tower.

2. The method of claim 1 wherein two of the tower segments are connected to one another in a shared connection area, wherein a first of the two tower segments and a second of the two tower segments each have in an interior, a ladder, which has in each case at least one ladder stile, wherein during the connection of the first tower segment with the second tower segment, the ladder stile or the ladder stiles in the first tower segment are spaced apart from the ladder stile or the ladder stiles in the second tower segment in the connection area, and wherein during the erection of the tower or during the assembly of the tower segments, in the connection area through the use of a ladder intermediate piece bridging the connection area of the tower segments, the ladder stile or the ladder stiles of the first tower segment are connected to the ladder stile or the ladder stiles of the second tower segment.

3. The method according to claim 2, wherein the ladder intermediate piece is arranged between the ladders of the tower segments without attachment to the tower segments or to the connection area of the tower segments or in that the load forces acting on the ladder intermediate piece are diverted to a lower ladder or an upper ladder.

4. The method according to claim 2, wherein by means of the ladder intermediate piece, in the condition arranged between the ladders, length tolerances of up to 200 mm (7.88 in.), or lateral tolerances of up to 200 mm (7.88 in.), are compensated.

5. The method according to claim 2, wherein a length tolerance compensation takes place between a lower step tread of the ladder intermediate piece and upper step tread of the ladder of the lowermost of the two tower segments or between a upper step tread of the ladder intermediate piece and lower step tread of the ladder of the uppermost of the two tower segments with the ladder intermediate piece arranged between the ladders.

6. The method according to claim 2, wherein the ladder of the first tower segment or the ladder of the second tower segment has a fall protection rail, which has the same length as the ladders, where between the ends of the fall protection rails to be connected for the first and second tower segment a fall protection rail of the ladder intermediate piece is fitted.

7. The method according to claim 2, wherein the length of the ladder of the first tower segment is less than the length of the first tower segment, so that the ends of the ladder are arranged in each case at a predetermined distance from the ends of the tower segment within the tower segment, and wherein the length of the ladder of the second tower segment is less than the length of the second tower segment, so that the ends of the ladder are arranged in each case at a predetermined distance from the ends of the tower segment within the tower segment.

8. The method according to claim 2, wherein two tower segments are connected to one another in a shared connection area, in which a first tower segment and a second tower segment each have a rigid power rail in the interior, in which upon connecting the first tower segment to the second tower segment in the connection area, the power rail in the first tower segment is at a distance from the power rail in the second tower segment, in which using a rail connection piece that bridges the connecting area of the tower segments and is variably adjustable in length, and able to be set variably in length, the power rail of the first tower segment are connected with the power rail of the second tower segment.

9. The method according to claim 8, wherein the power rail connection piece has at least two rail pieces, which are designed as detachably slidable, linearly, with one another or opposed to one another, in which at least one rail piece has a slot hole, in the linear sliding direction or in which at least one rail piece has an offset.

10. The use of ladders during or for the erection of a tower of a wind power plant, in which the tower is formed according to claim 1.

11. The use of power rails in a tower of a wind power plant, in which the tower is formed according to claim 1.

12. A method for erecting a tower of a wind power plant made of at least three tube-shaped tower segments, in which a tower segment is connected at a tower segment end with another tower segment in each case, comprising the steps of:

Providing multiple groups of non-individualized tower segments wherein the groups are of varying construction types (indicated by a letter A, B, C) with a number of tower segments in a group (indicated by a subscript letter i, m, n)

wherein the tower segments in a group of a particular construction type are of a standardized design and indistinguishable amongst themselves, but not individually matched or adapted to just one other specific tower segment in another group Arranging tower segments in a predetermined sequence: a tower segment of type A-a tower segment of type B-a tower segment of type C, one upon the other, Wherein in the arranging step the first tower segment, a tower segment of construction type A, is selected arbitrarily from a group having a plurality $i \geqq 2$ of type A tower segments $A_i$ which are constructed in the same way among themselves and exchangeable one for the other, wherein the second tower segment, a segment of the type B, is selected arbitrarily from a group having a plurality $m \geqq 2$ of type B tower segments $B_m$ which are constructed in the same way among themselves and exchangeable one for the other, and wherein the third tower segment, a segment of the type C, is selected arbitrarily from a group having a plurality $n \geqq 2$ of type C tower segments $C_n$ which are constructed in the same way among themselves and exchangeable one for the other, wherein two tower segments are connected to one another in a shared connection area, wherein a first of the two tower segments and a second of the two tower segments each have in an interior, a ladder, which has in each case at least one ladder stile, wherein during the connection of the first tower segment with the second tower segment, the ladder stile or the ladder stiles in the first tower segment are spaced apart from the ladder stile or the ladder stiles in the second tower segment in the connection area, wherein the length of the ladder of the first tower segment is less than the length of the first tower segment, so that the ends of the ladder are arranged in each case at a predetermined distance from the ends of the tower segment within the tower segment, wherein the length of the ladder of the second tower segment is less than the length of the second tower segment, so that the ends of the ladder are arranged in each case at a predetermined distance from the ends of the tower segment within the tower segment, and wherein during the erection of the tower or during the assembly of the tower segments, in the connection area through the use of a ladder intermediate piece bridging the connection area of the tower segments, the ladder stile or the ladder stiles of the first tower segment are connected to the ladder stile or the ladder stiles of the second tower segment.

13. The method according to claim 12, wherein the ladder intermediate piece is arranged between the ladders of the tower segments without attachment to the tower segments or to the connection area of the tower segments or in that the load forces acting on the ladder intermediate piece are diverted to a lower ladder or an upper ladder.

14. The method according to claim 12, wherein a length tolerance compensation takes place between a lower step tread of the ladder intermediate piece and upper step tread of the ladder of the lowermost of the two tower segments or between a upper step tread of the ladder intermediate piece and lower step tread of the ladder of the uppermost of the two tower segments with the ladder intermediate piece arranged between the ladders.

15. The method according to claim 12, wherein the ladder of the first tower segment or the ladder of the second tower segment has a fall protection rail, which has the same length as the ladders, where between the ends of the fall protection rails to be connected for the first and second tower segment, a fall protection rail of the ladder intermediate piece is fitted.

16. The method according to claim 12, wherein two tower segments are connected to one another in a shared connection area, in which a first tower segment and a second tower segment each have a rigid power rail in the interior, in which upon connecting the first tower segment to the second tower segment in the connection area, the power rail in the first tower segment is at a distance from the power rail in the second tower segment, in which using a rail connection piece that bridges the connecting area of the tower segments and is variably adjustable in its length, and able to be set variably in length, the power rail of the first tower segment are connected with the power rail of the second tower segment.

17. The method according to claim 16, wherein the power rail connection piece has at least two rail pieces, which are designed as detachably slidable, linearly, with one another or opposed to one another, in which at least one rail piece has a slot hole, in the linear sliding direction or in which at least one rail piece has an offset.

18. The method according to claim 12, wherein by means of the ladder intermediate piece, in the condition arranged between the ladders, length tolerances of up to 200 mm (7.88 in.), or lateral tolerances of up to 200 mm (7.88 in.), are compensated.

19. The method according to claim 18, wherein length tolerances of up to 100 mm (3.94 in.) are compensated.

20. The method according to claim 18, wherein length tolerances of up to 40 mm (1.57 in.) are compensated.

21. The method according to claim 18, wherein lateral tolerances of up to 100 mm (3.94 in.) are compensated.

22. The method according to claim 18, wherein lateral tolerances of up to 50 mm (1.97 in.) are compensated.

23. The use of ladders during or for the erection of a tower of a wind power plant, in which the tower is formed according to claim 12.

24. The use of power rails in a tower of a wind power plant, in which the tower is formed according to claim 12.

* * * * *